US007112261B1

(12) United States Patent
TerWisscha et al.

(10) Patent No.: US 7,112,261 B1
(45) Date of Patent: Sep. 26, 2006

(54) SAFETY SYSTEM AND METHOD FOR A COKING FACILITY

(76) Inventors: Rick TerWisscha, 7467 Hannegan Rd., Lynden, WA (US) 98264; Guy Maakad, 6982 Hannegan Rd., Lynden, WA (US) 98264

( * ) Notice: Subject to any disclaimer, the term of this patent is extended or adjusted under 35 U.S.C. 154(b) by 465 days.

(21) Appl. No.: 10/359,888

(22) Filed: Feb. 7, 2003

Related U.S. Application Data

(60) Provisional application No. 60/356,991, filed on Feb. 12, 2002.

(51) Int. Cl.
*C10B 43/00* (2006.01)

(52) U.S. Cl. ..... 201/2; 202/241; 134/22.18; 408/1

(58) Field of Classification Search ..... 202/242, 202/241, 250; 201/2, 7, 41; 196/122; 408/1, 408/59; 134/22.18, 167 R, 183; 141/346
See application file for complete search history.

(56) References Cited

U.S. PATENT DOCUMENTS 3,880,359 A * 4/1975 Novy ..... 239/565
4,626,320 A * 12/1986 Alworth et al. ..... 201/2
5,855,742 A * 1/1999 Lumbroso et al. ..... 202/241
6,066,237 A * 5/2000 Kindersley ..... 202/242
6,206,059 B1 * 3/2001 Maakad et al. ..... 141/346
6,228,225 B1 * 5/2001 Meher-Homji ..... 202/250
6,652,714 B1 * 11/2003 Breaux ..... 202/241
2003/0213507 A1 * 11/2003 Martin et al. ..... 134/34
2004/0118746 A1 * 6/2004 Wilborn et al. ..... 208/131
2004/0238662 A1 * 12/2004 Paul ..... 241/1
2004/0253066 A1 * 12/2004 Paul ..... 408/124

* cited by examiner

*Primary Examiner*—N. Bhat
(74) *Attorney, Agent, or Firm*—Robert B. Hughes; Hughes Law Firm, PLLC

(57) ABSTRACT

A safety system for a coking facility where there is a coke drum and a drill assembly. When the coke accumulates in the drum, a drill head of the drill assembly is lowered into the coke drum to emit high pressure water jets to remove the coke from the coke drum. There is a enclosing structure with an access door which is fixedly mounted at a location above an upper opening of the coke drum, so that when the drill head is moved out of the coke drum and there is an accidental jet water discharge, it will be redirected at a location within the enclosing structure. Interlock systems are provided.

20 Claims, 7 Drawing Sheets

DRILL STEM RETRACTED (SIDE)

DRILL STEM RETRACTED (SIDE)

DRILL STEM RETRACTED (ELEVATION)

(FOR TRUE ORIENTATION SEE PLAN)

PLAN

EXPLODED VIEW

END

ELEVATION

PLAN

DRILL STEM RETRACTED (ELEVATION)

SAFETY SYSTEM AND METHOD FOR A COKING FACILITY

RELATED APPLICATIONS

This application claims priority benefit of U.S. Ser. No. 60/356,991, filed Feb. 12, 2002.

BACKGROUND OF THE INVENTION a) Field of the Invention

The present invention relates generally to coke drums, and more particularly to an apparatus which is used in connection with a drill assembly that is used in the coking drums for removing the coke from the coke drum.

b) Background Art

Coke is commonly made in a petroleum processing facility as follows. The petroleum product goes through a fractionating process where some of the more volatile material is extracted, and the petroleum product that remains is a heavy, more viscous petroleum product which is at about 720° degrees F. when it leaves the fractionator. This is passed through a heater which raises the temperature of the petroleum product to about 930° degrees F., and this petroleum product is directed through a switch valve alternatively into one or the other of two coke drums. When the petroleum product is being directed into the first coke drum, the coke drum is substantially closed. The feeding of the viscous petroleum product is continued until it reaches a level in the first drum which is about 20 feet from the top of the drum. When the first coke drum is filled to this level, then the switch valve is operated to direct the viscous petroleum product into the second coke drum.

With filling of the first drum being completed, steam is directed upwardly through the petroleum product in first the drum to drive off the lower boiling point volatiles which are discharged from an upper coke drum opening and through one or more vents. After a period of time when removal of the lower boiling point volatiles from the coke has been completed, there remains the coke product which is in the form of a porous solid.

The next step is to cool this porous solid coke product, and this is accomplished by passing water upwardly through the coke product that is still in the drum. After this cooling period, a drill head which is attached to a drill stem is lowered into the coke drum through the top central opening in the coke drum. When the drill head reaches the proper operating position, the drilling starts by use of high pressure water jets (e.g. 3,000–4,000 PSI). In accomplishing the drilling process, the drill head is first set so that the high pressure water will be discharged through the pilot jets which are arranged to drill downwardly to form a central hole in the coke material. Then the drill stem is raised to lift the cutting head out of the coke drum, and the setting of the cutting nozzles is changed so that the laterally directed cutting jets will operate. The drill head is moved downwardly again into the coke drum and when it reaches the level of the petroleum product, the other set of water jet nozzles are used to discharge laterally directed water jets to remove the rest of the coke material from the wall of the coke drum. During this time, the bottom closure plate is opened to permit the water with the coke product to be discharged from the bottom of the drum, and from there is carried to another location. With this being completed, the first drum is again filled with the viscous petroleum product, and at the same time the process described above is repeated in the second drum which has now already been filled with the viscous petroleum product.

The system is arranged so that when the drill head is moved up above the level of the coke drum, an automatic interlock operates which prevents the water to be discharged from the nozzles. However, it could occur that this interlock may be disabled or otherwise made inoperative, so that when the drill stem is brought up, the water jets could be discharged outwardly at a high velocity, thus possibly causing damage to various equipment, injuring personnel, or even killing nearby personnel.

SUMMARY OF THE INVENTION

The system of the present invention is particularly adapted for use in a coking facility for the purpose of increasing safety and minimizing exposure of personnel. More particularly, the system of the present invention is used in that portion of the coking facility where there is at least one coke drums and also a drill assembly. The coke drum has an upper end opening defined by a surrounding opening structure of the coke drum. The drill assembly comprises a drill stem, a drill head at a lower portion of the drill stem, and a liquid discharge system. The liquid discharge system provides high pressure liquid for a liquid discharge section thereof at the drill head.

The drill assembly is arranged to raise and lower the drill head between a lower operating position where the liquid discharge section is position within the drum, and an upper retracted position. In the lower operating location within the drum, the liquid discharge section emits a liquid jet discharge in the coke drum for removal of the coke material in the drum. In the retracted position, the drill head is above the drum at a retracted location. The components which are described above in the section entitled "Summary of the Invention", already exist in the prior art. The components which are newly added to the prior art components noted above to form the combination of the present invention, are as follows.

There is added an enclosing structure which is located above the upper end opening of the coke drum so as to enclose the retracted location that is above the coke drum in a manner that if the drill head is in the retracted location and emits a discharge therefrom, the enclosing structure causes the jet discharge to be redirected at locations in the enclosing structure.

Also, there is an access system which comprises an opening structure in the enclosing structure to provide access to the drill head in its retracted position, and a door which is moveable between a closed position and an open position. With the door in its closed position, it blocks the jet discharge passing out through the access opening, and with the door in its open position, it permits access to the drill head inside the enclosing structure.

In a preferred form, there is a guide section location relative to the enclosing structure so as to be above the drill head with the drill head in its retracted position. The guide section has a through opening to accommodate the drill stem and is arranged to center the drill stem so that the drill head properly travels into and from the coke drum. The guide section in one preferred form, comprises a brass bushing which engages the drill stem and prevents unwanted sparking. Also, in a preferred form, the guide section is arranged to limit upward travel of the drill head outside of a region within the enclosing structure.

In this preferred embodiment, there is a door interlock system which is responsive to the door being in its open or closed position. This door interlock system has an operative connection to the liquid discharge system so as to be able to prevent flow of high pressure liquid form the discharge section at the drill head, in a manner that when the door is in the open position, jet liquid discharge from the discharge section at the drill head is prevented. In one preferred form, there is a door interlock control valve in the liquid discharge system, and the door interlock system operates to close the door interlock control valve when the door is in the open position.

Also, in a preferred form, there is a drill head interlock system which is responsive to location of the drill head and has an operative connection to the liquid discharge section. The drill head position interlock system is arranged so that when the drill head is moved out of its operating position within the drum, the liquid discharge system is prevented from discharging liquid through the discharge section at the drill head. In a specific embodiment shown herein, the head portion interlock system has a head portion interlock control valve to prevent flow from the liquid discharge section at the drill head. The door interlock control valve and the drill head position interlock control valve are in series so that when either of the interlock systems are operative to close its control valve, flow of the jet discharge to the discharge section at the drill head is prevented.

Further, in the preferred embodiment, there is a venting system to cause cooling air to enter a region defined by the enclosing structure, and to flow from the region defined by the venting structure to have a cooling effect within the enclosed structure. In a specific embodiment shown herein, the venting system comprises an inlet air section to enable air to enter into a lower portion of the region defined by the enclosing structure, and an air outlet section to enable flow in the region defined by the enclosing structure to flow outwardly from the enclosed structure.

Also, in a preferred form, the air outlet section comprises structure at an upper end location of the enclosing structure, and there is a venting structure at said upper end location.

The door of the access system is in one version hinge-mounted to the enclosing structure and in another version in slide-mounted to the enclosing structure.

Also, it should be understood that while the various components that are disclosed in this text are described as having a specific configuration and mounted in a certain position or in a specific manner, and there are other aspects described in specific terms, these are not to be interpreted as limiting the language in the claims. Rather, this description is to show presently preferred embodiments. There are many mechanical and functional variations that are possible. For example, while a particular fastening device or means is described, it is well within the skill of the art to use other equivalent components or arrangements. Further, while various shapes are specified (e.g., an item being cylindrical, elongate, etc.) it is evident to those skilled in the art that there could be other configurations.

In the method of the present invention, the components which are described above are employed in the method. The enclosing structure is position above the end opening of the coke drum so as to enclose the retracted location of the drill head. Thus, if the drill head is in the retracted location and emits a jet discharge therefrom, the enclosing structure functions to redirect the jet discharge.

Further, the method of the present invention also provides access through the enclosing structure to said operating head in its retracted position by providing an access opening in the enclosing structure, and also providing a door which is moveable between a closed and open position. This is done in a manner with the door in its closed position, the door functions to block the jet discharge from passing out through the access opening, and with the door in its open position, permitting access to the drill head inside the enclosing structure. Other features of the present invention will become apparent from the following detailed description.

DETAILED DESCRIPTION OF THE PREFERRED EMBODIMENTS

It is believed that a better understanding of various features of the present invention will be obtained by first describing a prior art coking drum and drill assembly, such as shown in U.S. Pat. No. 5,022,799, and then describing more specifically the prior art components which are utilized in the safety system of the present invention, with these being followed by a description of the newly added features of the combination in the present invention.

Figure 1:
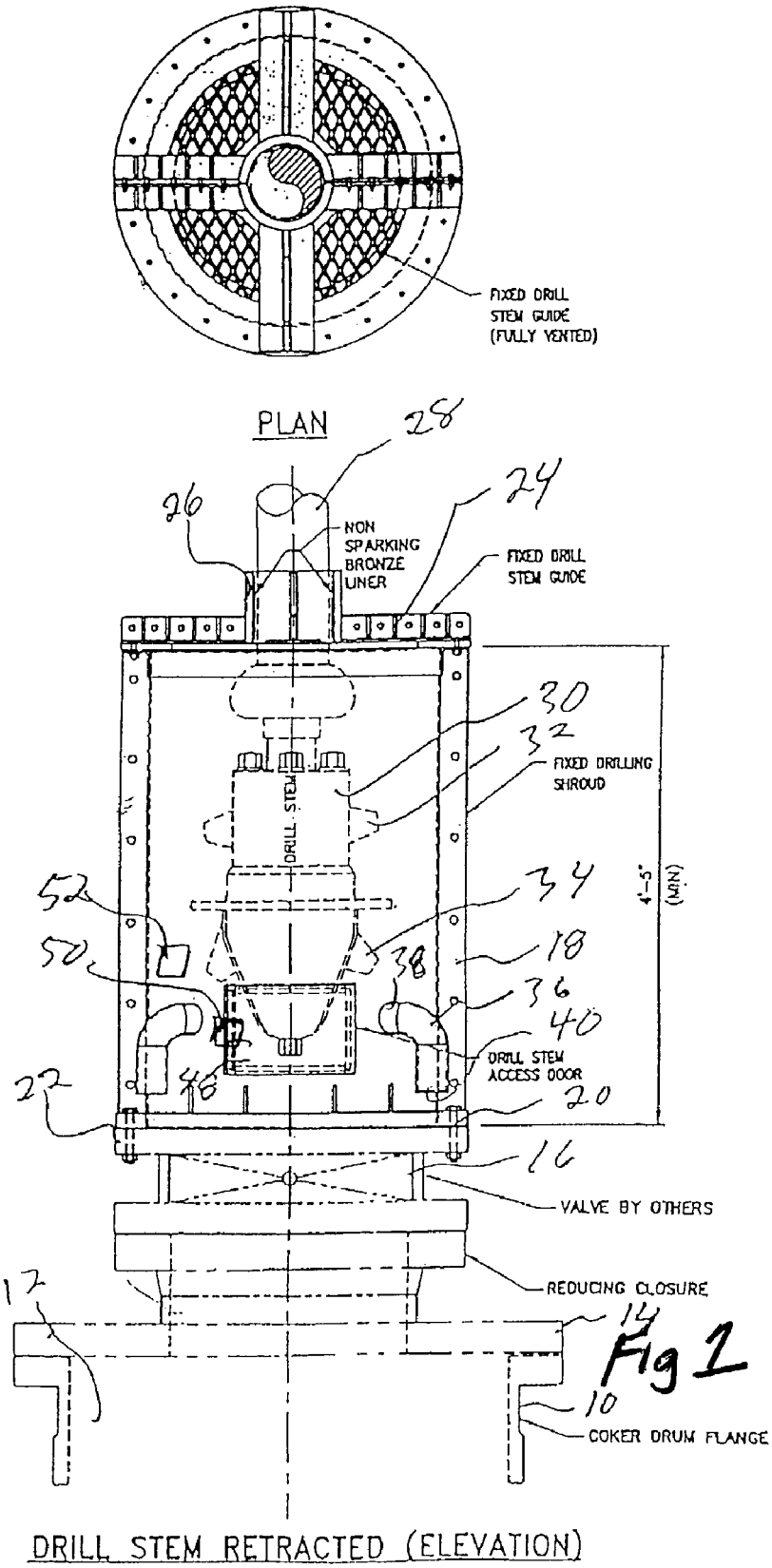
FIG. 1 is a side elevational view showing the prior art apparatus of U.S. Pat. No. 5,022,799.

Reference is first made to FIG. 1, which is labeled Prior Art, and which is the first page of the drawings shown in U.S. Pat. No. 5, 022,799 (Torres et al.) issued Jun. 11, 1991. There is shown a coke drum 1 having an upper lid 2 and a lower lid 3. At the lower portion of the feed inlet 4 connected to a feed line 5, and these are to transfer the heaviest portion of the crude oil (commonly referred to as "residual oil") into the coke drum 1. At the top end of the drum 1, is an aperture 6 with a flange 7 surrounding the aperture 6.

There is provided a drill assembly which comprises a fluid source 8 to direct the high pressure water that is used as a drilling medium to the drill stem 9. A "cutting tool 10" is mounted to the lower end of the drill stem 9. In FIG. 1, the drill assembly is shown in its retracted position and in operation, the drill stem is lowered so that the cutting tool 10 descends into the chamber defined by the coke drum 1, and high pressure water (e.g. 3,000 lbs. per square inch pressure) is directed through suitable jet nozzles to remove the solid product which has accumulated in the coke drum 1.

This prior art patent, (U.S. Pat. No. 5,022,799) is directed primarily toward the task of aligning the drill stem, and there is shown an alignment device 11 which serves the function of centering the drill stem 9 in the aperture 6, and the clamping device (generally depicted at 12). Also there are rotational stops 20 and 21.

Figures 2, 2A, 2B:
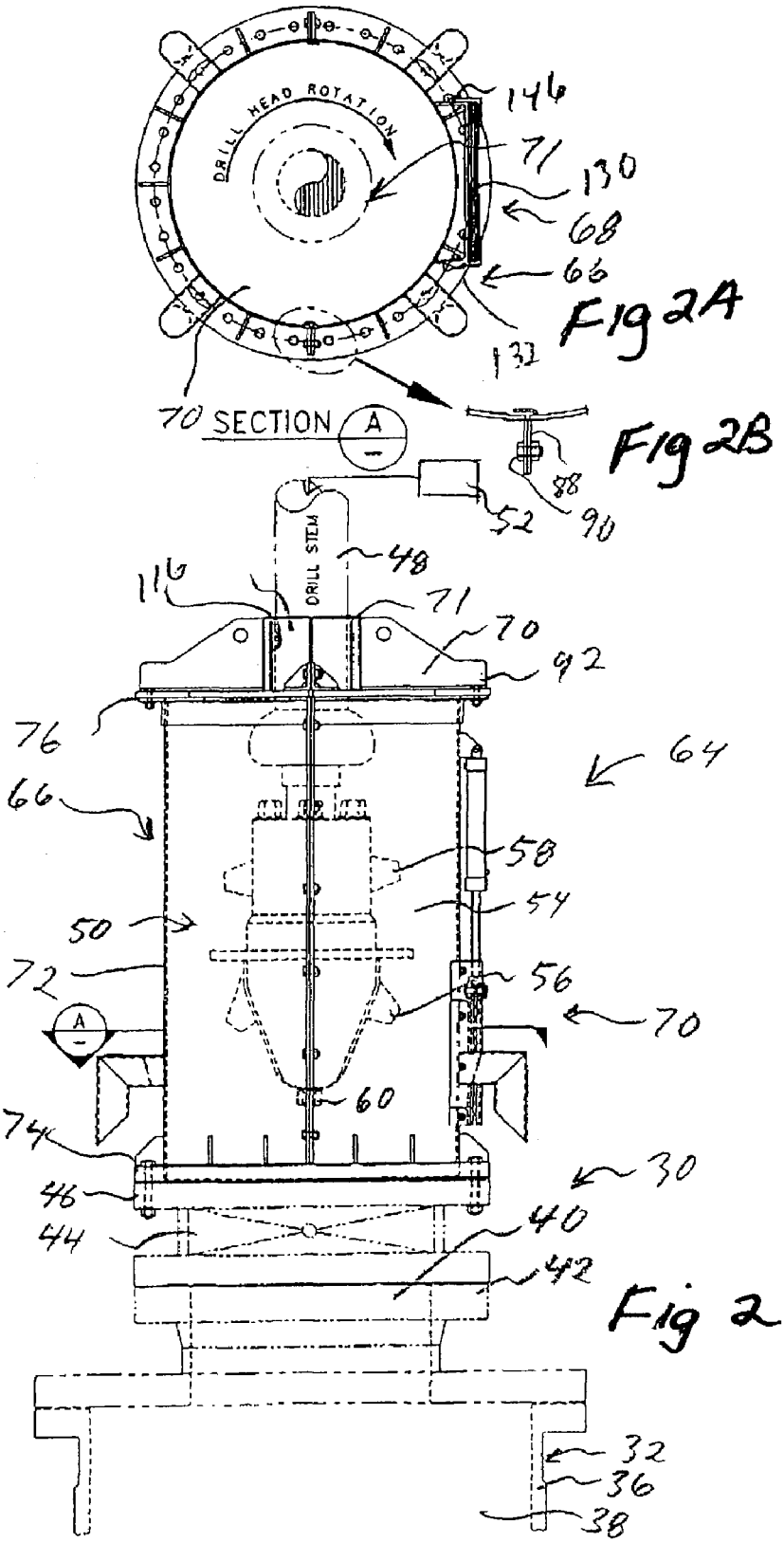
FIG. 2 is a side elevational view of the apparatus of the present invention with the safety system of the present invention mounted to a coke drum, with the drill assembly being shown in broken lines.
FIG. 2*a* is a sectional view taken in a plane transverse to the longitudinal center line of the structure shown in FIG. 2.
FIG. 2*b* is a sectional view showing a detail of the connection made between two half wall sections of the structure of FIG. 2.

With the foregoing being given as further background information, reference is now made to FIG. 2 and following, and there will now first be given a description of those components in the combination of the present invention which already exist in the prior art. This will then be followed by the description of the other components which are added to the prior art components.

As shown in FIG. 2, the prior art apparatus 30 of the combination of the present invention comprises two main components, namely the coke drum 32 and the drill assembly 34. The drum 32 is or may be substantially the same as shown in FIG. 1 (showing the prior art apparatus of U.S. Pat. No. 5,022,799), and for ease in illustration, only the upper cylindrical wall portion 36 of the coke drum 32 and the upper portion of the drum chamber 38 are shown. The drum 32 has an upper aperture or opening 40 defined by a surrounding structure 42. Mounted to the surrounding structure 42 is a valve 44 having an upper flange 46. In this particular arrangement, this valve 44 has a plate-like valve element which moves laterally from its closed position, shown in FIG. 2, to its open position. However, within the broader scope of the present invention, other valve configurations could be used, such as a ball valve.

The drill assembly 34 comprises a cylindrical drill stem 48 having a drill head 50 at the lower end thereof. There is a liquid supply system 51 which comprises a supply section 52 that delivers the high pressure water to a water jet discharge section 54 which is mounted to the drill head 50. The discharge section 54 comprises pilot jet nozzles 56 and cutting jet nozzles 58. As is common in the prior art, the pilot jet nozzles 56 are directed primarily in a more downward and outward direction, and the cutting jet nozzles 58 direct the water jets more laterally, with these nozzles 58 removing the rest of the product that has accumulated within the drum 32.

At the lower part of the drill head 50 there is a water jet control member 60 (it is shown herein as a nut 60), which is moved between first and second positions, one position to cause flow through the pilot nozzles 56, and in the second position causing jet flow through the laterally directed cutting nozzles 58. Alternatively, instead of having the nut 60, there could be a hydraulically, pneumatically, or electrically operated control mechanism or some other control device. Also, there would be in this prior art apparatus a drill head interlock system which would operate in a manner that when the drill head 50 is moved out of the drum 32, the flow of water to the nozzles 56 and 58 is prevented.

As indicated above, drum 32 (along with its components 36–46) and the drill assembly 34 (along with the components 48–60) already exist in the prior art, and it is to be understood that there are other arrangements that the coke drum and the drill assemblies perform the same basic functions and could be utilized in the combination of the present invention.

There will now be a description of the components of the system of the present invention which are the newly added features of the combination of the present invention. As a preliminary comment, one of the benefits of the present invention is that it can be adapted to be installed in a variety of prior art coking operations, and this would include the prior art system shown in FIG. 1, as well as others which are used in various commercial installations.

To describe now the main components of the present invention which are added to the prior art components described above, reference is first made to FIGS. 2, 2A, and 2B.

The system 64 comprises an enclosing structure 66 which is centered on a longitudinal center axis 67, an access system 68, a venting system 70, and a drill assembly guide section 71.

The enclosing structure 66 comprises an enclosing wall 72 which has a lower end portion 74, an upper end portion 76, and an intermediate enclosing wall portion 78. The lower portion 74 has an attaching structure 80 which, in this preferred embodiment, has a cylindrical configuration and diameter matching that of the upper valve flange 46. There are members or devices 82 which connect the attaching structure 80 to the flange 46, such as the nut and bolt fasteners shown at 82.

The intermediate enclosure wall portion 78 has a cylindrical configuration matching that of the attaching structure 80, and extends upwardly to a sufficient height to enclose the drill head 50 when the drill head 50 is in its upper retraced position, and more specifically, is positioned so that in the event that any of the jet nozzles 56 and 58 begin emitting the high pressure water jets while in the retracted position above the drum 32, the high pressure water jets would be contained by the intermediate enclosing wall portion 78.

There is formed in the intermediate enclosure wall portion 78 an access opening 84. This access opening 84 is positioned so that a workman would be able to either reach through the opening 84 or move at least partly through the access opening 84 so as to be able to manipulate the control member 60 at the bottom part of the drill head 50, and also to perform maintenance (or minor maintenance) or inspection at the drill head.

Figure 4A:
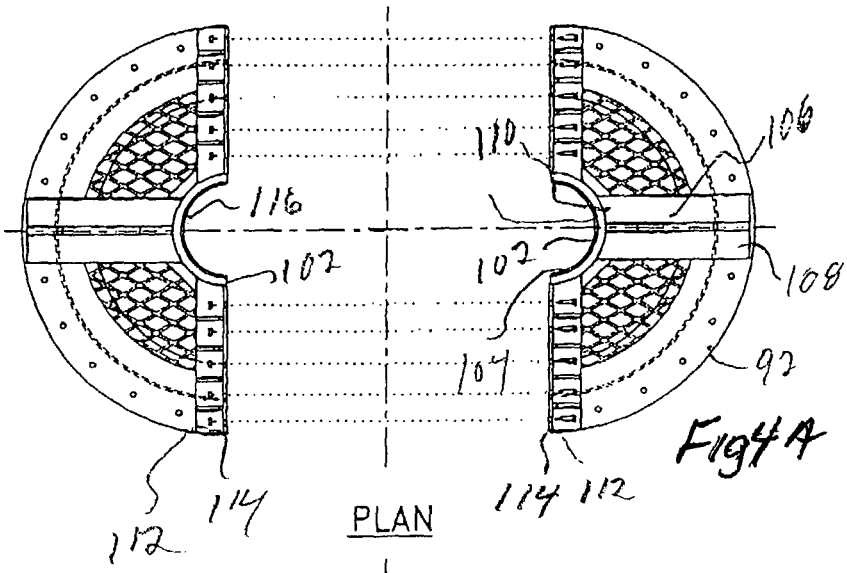
FIG. 4*a* is a view similar to FIG. 2A, except showing the two top end structures separated from one another.
Figure 4:
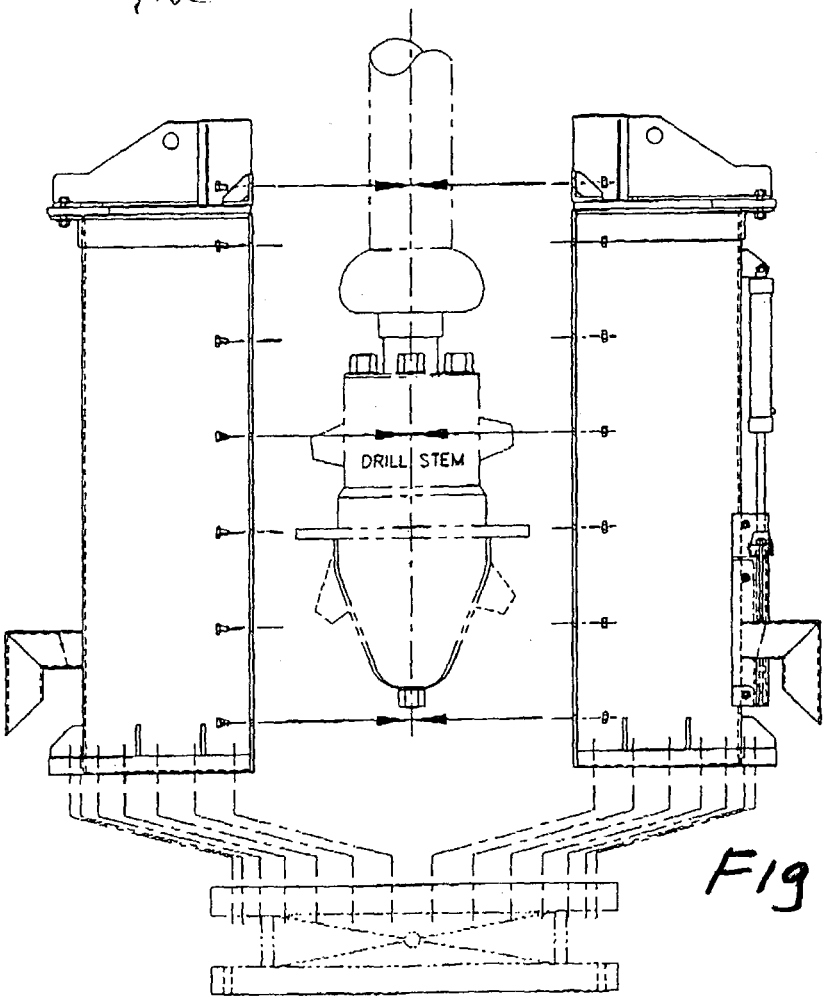
FIG. 4 is an exploded side elevational view similar to FIG. 2, showing the two path sections of the structure separated from one another laterally.

As shown in FIGS. 4 and 4A, the enclosing structure 66 is formed in two half sections which are separated along a vertical plane that is coincident with the vertical longitudinal center axis 67 of the structure 66. At the connecting locations of the two half sections, there are provided connecting flanges 88 (see FIG. 2B) that are connected by suitable connectors, such as the nut and bolt connections shown at 90.

The upper wall portion 76 is at the upper edge portion of the intermediate enclosure wall portion 78, and comprises an upper circumferential support structure 92 which is bolted or otherwise connected to an upper reinforcing structure 94 at the upper perimeter edge of the upper end of the enclosing wall 72. The perimeter structure 92 defines a central open region 96 which is or may be coextensive (i.e., extending across the same area), or nearly coextensive, with the interior region or chamber 98 which is defined by the enclosing wall portion 78. There is a vented cover 100 extending across the central open region 96, which permits the passage of vapor, air, or other gaseous substances.

At the location of the perimeter structure 92, there is located adjacent to the longitudinal vertical axis 67, a generally cylindrical surrounding guide structure 102 which can be seen in FIG. 4 to compose two semi-circular guide members 104 that are connected to the perimeter structure 92 by radially aligned support members 106 that are each connected at one end 108 to the perimeter structure 92, and at the other end 110 connected to the semi-circular guide member 104. Also, there are two other radially aligned support members for the semi-circular guide members 104, these being indicated at 112. These members 112 have the additional function of being a portion of the connecting flanges 114 by which the two half cylinder sections 86 are connected to one another. Each of these semi-circular guide structures 102 has an inside semi-circular lining 116 made of brass that form a circular bushing which receives the drill stem 48. This brass bushing not only serves as a proper guide member, but also avoids the creation of sparks in this region.

It will be noted that the drill stem 48 is sized so that it will fit within the opening defined by the bushing member 116 positioned within the guide structure 102 made up of the two semi-circular guide members 104, and that the structure at the drill head has a larger diameter. Thus, not only does the guide structure 102 properly center the drill stem 48 and the drill head 80 and stabilize these in a center location, but it also prevents the drill head from being moved upwardly outside of the confines of the enclosing structure 66 so that the jet discharge could occur over the upper edge portion of the enclosing structure 66.

To describe now the aforementioned venting system 70, there is an air intake venting section 118 located at the lower part of the intermediate enclosing wall portion 78, and this section 118 comprises a plurality of air intake members 120. As shown herein, there are four air intake members 120, and each of these comprises a right angle intake conduit 122, having a lateral conduit portion 124 leading into the interior region 98 of the enclosing structure 66, and a downwardly extending intake conduit portion 126 having a lower intake open end 128.

The other section of the venting system 70 comprises the aforementioned vented cover 100. As shown herein, this vented cover has a diamond-shape pattern made up of intersecting cross-members which can be of conventional construction, such as having a plurality of structural members having a greater vertical depth dimension than the thickness dimension, and interconnecting with each other at intervals to provide adequate venting as well as a sufficiently strong structure.

Figure 5:
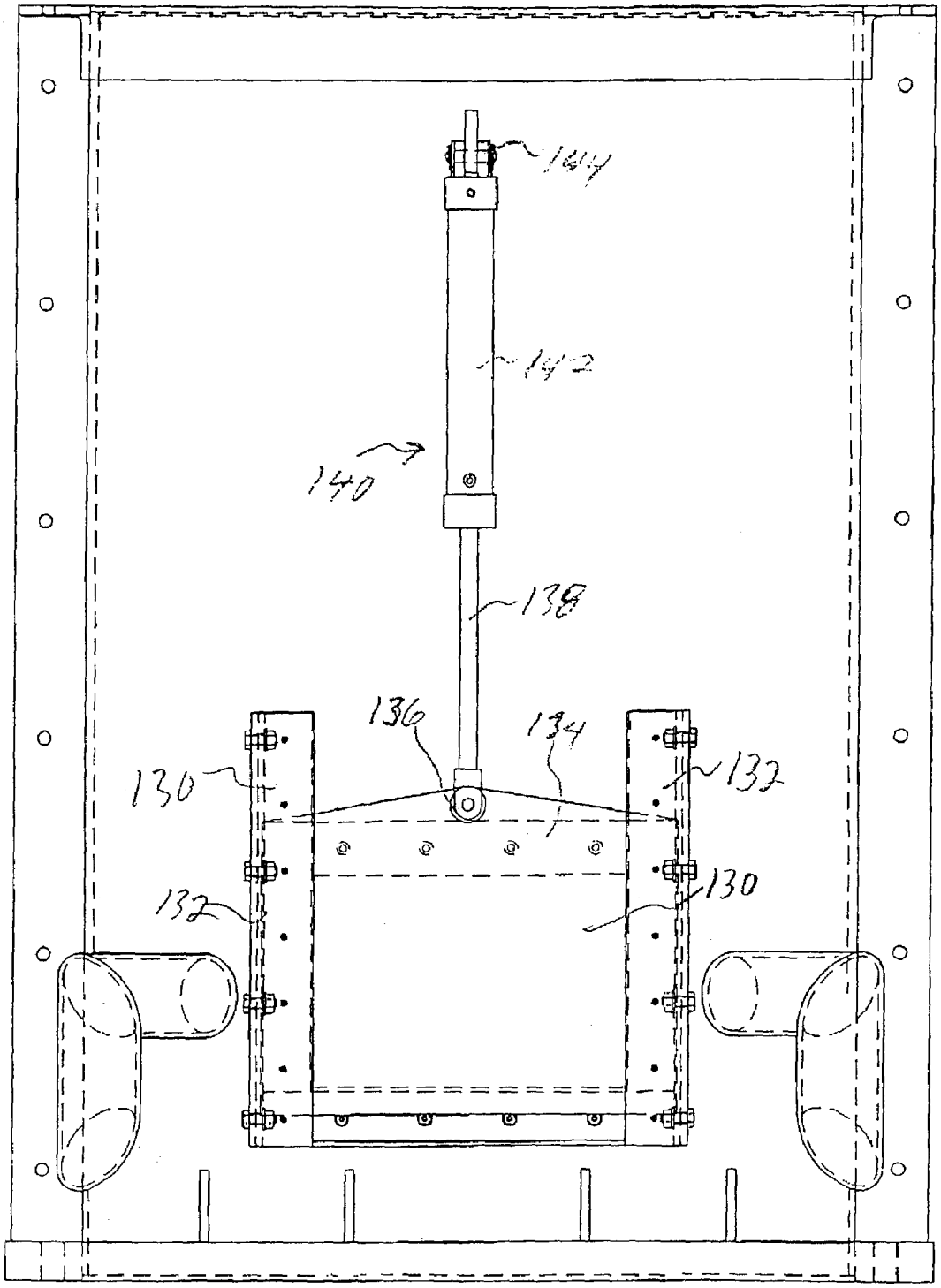
FIG. 5 is a front elevational view similar to that of FIG. 3, with certain components omitted, and showing components of the access system and the venting system of the present invention.

The aforementioned access system 68 comprises the aforementioned access opening 84 which is formed in the intermediate enclosing wall portion 78, and (as indicated earlier) this access opening 84 is made sufficiently large and is positioned so that access can be obtained to the control member 60. The access system 68 comprises a door 130 which closes access opening 84. In this particular embodiment, the door 130 has a rectangular configuration. As can be seen more clearly in FIG. 5, the door 130 is mounted by its edge portions to two vertically aligned and laterally spaced slideways 132 which enclose the vertical edge portions of the door 130.

The door 130 has an upper horizontally aligned cross member 134 which has a central connecting member 136, that is in turn connected to a rod member 138 which is part of a hydraulic actuator 140, or which could be pneumatic, electric, or powered in some other way. The cylinder 142 of the hydraulic actuator is connected at an upper end location 144 to the wall structure 72. It can be seen by viewing FIGS. 2*a* and 6 that there are at the two vertical slideways 132 two side structures 146 that close a gap which would otherwise exist between the slideways 132 and the cylindrical surface of the wall structure 72.

Figures 6, 7:
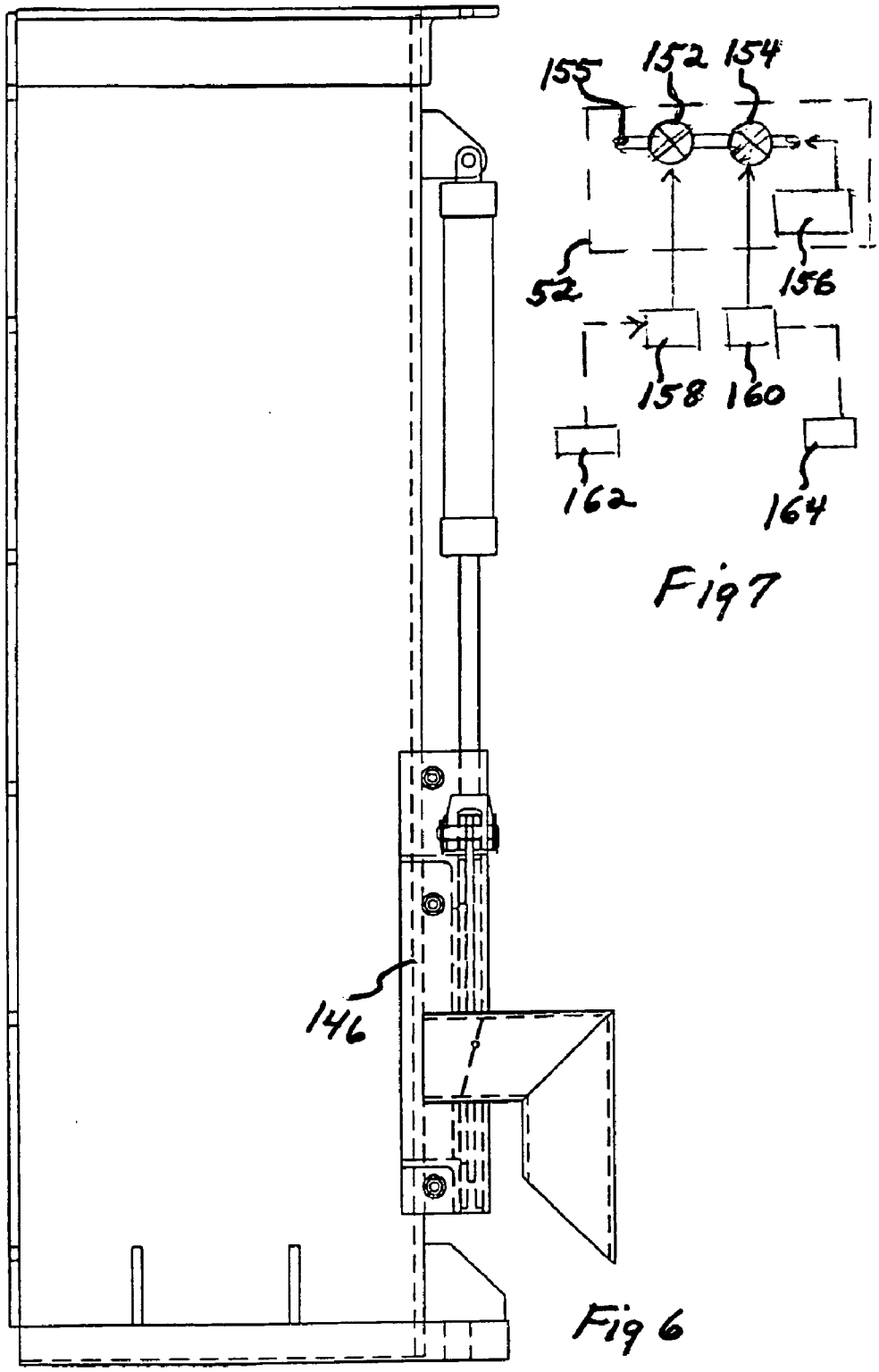
FIG. 6 is a side elevational view of a half section of the structure as shown in FIG. 5.
FIG. 7 is a schematic drawing showing the interlock systems of the present invention.

Reference is now made to FIG. 7 to describe the interlock system of the present invention. As indicated earlier in this text, it would be common in the prior art coking operation to have an interlock connection to the drill assembly and to the water supply section, so that when the drill head is moved out of the confines of the coke drum 32, the water supply system is inactivated or locked in an inactive position so that none of the high pressure water is directed to the nozzles 56 and 58. It was also indicated earlier in this text that as part of the access system 68, there is an interlock between the access system 68 and the liquid supply section 51 so that if the door 130 is opened, none of the high pressure water is directed out of the nozzles 56 and 58.

One exemplary embodiment of this interlock system is illustrated in FIG. 7. The aforementioned high pressure liquid supply 52 is shown to have two flow control valves 152 and 154 which are connected in series to an outlet 155. There is a water supply source at 156 which leads to the valves 152 and 154, and the outlet 155 leads to a line that supplies the high pressure water through the drill stem 48 to the drill head and thence out the jets 56 or 58, selectively. If either of these valves 152 or 154 is closed, then none of the high pressure water will flow from the source 156 to the drill head 50.

There is provided a valve control member 158 for the valve 152 and a second control member 160 for the valve 154. There is a first sensor 162 which is responsive to the positioning of the drill head 50, so that when the drill head 50 is being retracted from its operating location within the drum 32, this is detected by the sensor 162 to cause the control member 158 to close the valve 152 so that the high pressure water system is inactivated or locked so that the water flow to the jet nozzles 56 and 58 is stopped. There is a second sensor 164 which has an operative connection to the access system 68, so that when the door 130 is opened this is detected by the sensor 164 to cause the control member 160 to close the valve 154 so that the high pressure water supply system 52 is also inactivated or locked into its non-discharge position.

Each of these sensors 162 and 164 can be provided in a variety of configurations and with various modes of operation. For example, there could be a simple position sensor located somewhere along the drill stem 48, so that when it reaches a certain position it activates a lever, a whisker switch, a button, a transmitter, or other device to cause a signal to be sent to its control system 158. There could be an electric eye system where a beam is broken. There could be a magnet placed on a device, and a Hall effect sensor or the like would react to the presence of the magnetic field at a certain location. The signal could be transmitted through electromagnetic wave communication, through an electric wire, acoustically, etc. Also, there could be a direct mechanical connection where an electric current acts on a solenoid to mechanically close a valve.

These same options exist for the other control device 164 that is responsive to the position of the door 130. Since the various ways of accomplishing this are well known to those of ordinary skill in this art, these will not be described in any further detail herein.

Also, it should be noted that the interlock system of FIG. 7 could be made separate from another control system or systems that would be present. For example, the control device 60 on the drill head 50 could have three positions, with one delivering high pressure water to one or the other sets of jet nozzles 56 and 58, or shutting these off totally. In addition, there could be an on/off switch connected to yet another valve so that the water flow could be started or stopped at a master control location. Then, the valves 152 and 154 of the two interlock systems could be at yet another location so that there would be less likelihood of these being shut off inadvertently, or possibly incapacitated by some occurrence near the main control location. Further, since the two valves 152 and 154 are in series with one another, both interlock systems would have to fail before the water jets 56 or 58 could do any damage.

To describe now the operation and various functions of the safety system of the present invention, as indicated above, this system can be installed in existing coking facilities with little modification or adjustment in the overall coking facility, and quite possibly with substantially no modifications or adjustments. The enclosing structure 66 is arranged so that the lower structural portion 74 of the enclosing structure 66 can be attached to an existing valve flange 46, by using conventional connectors (e.g., the nut and bolt connectors as shown). Obviously, there are any number of connecting devices which could be used, and since these are all well known to people of ordinary skill in this art, these will not be itemized. However, for reasons of safety and reliability, the connection to the flange 46 should be made as a substantially permanent connection which would normally always remain fixedly in place, except for maintenance operation, repair, or etc.

However, prior to fixedly connecting the enclosing structure 66 to the flange 46 as part of the upper structure of the drum 32, the drill stem 48 and the drill head 50 of the drill assembly 34 are positioned centrally over the drum 32, and then the two half sections 86 of the enclosing structure 66 are put into place and the connections are to form the half sections into a single rigid structure. In one arrangement, the two half sections could be each pre-made with some or all of the components attached thereto already in place as part of the structure. For example, the two half sections of the upper perimeter structure 92, the reinforcing structure 94, the guide structure 102, the two portions of the vent cover 101, the semi-circular guide members 102 with their bushing members 116 could all be pre-assembled. Also, the slideways 132 and the side structures 146 could be pre-attached to their related half sections 86. The actual installation of the door 130 and the door actuator 140 could if desired be accomplished after the enclosing structure 66 is installed, and quite possibly also the air intake vent members. The sequence of connecting the various components could obviously be varied.

In the normal mode of operation, the coking operating would proceed in the usual manner. When either of the drums has accumulated the proper amount of the vicious petroleum product, with the product being treated in a manner to transform this into a coke product, and after the cooling has taken place, then it comes time to remove the accumulated coke product from the drum by opening the upper valve 44 at the top of the coke drum 32, and lowering the drill head into the interior of the coke drum to start the coke removal operation. Initially, the control device 60 has been set so that the pilot jet nozzles 56 will operate to drill a central hole downwardly through the accumulated coke material. After this, the drill head 50 is raised to a position above the coke drum, and the operator causes the hydraulic actuator 140 to lift the door 130. Then, the operator moves the control device 60 so that the cutting jet nozzles 58 are in the operating position. The drill head is again lowered into the drum 32, and the water supply system is caused to operate to in turn cause the high pressure water jets to shoot laterally into the accumulated coke product, and cause the coke product to be removed from, and fall out the bottom of, the coke drum. At this time, the lower closure member of the coke drum 32 is open so that the water with the accumulated coke is discharged to another processing location.

During this time, the safety system of the present invention is in its operating mode so that every time the drill head 50 is raised out of the coke drum, the sensor 162 causes the control device 158 to close the valve 152. Then, as soon as the door 130 is opened, the sensor 164 causes the control member 160 to close the valve 154. When the door 130 is shut, this causes the sensor 164 to cause the valve 154 to open. Then, when the drill head 50 moves downwardly to be positioned within the drum 32, the sensor 162 causes the other valve 152 to open. Then, at a central operating location, the water supply system could be activated to cause the high pressure water to be delivered to the water jets 56 or 58.

Figures 3, 3A:
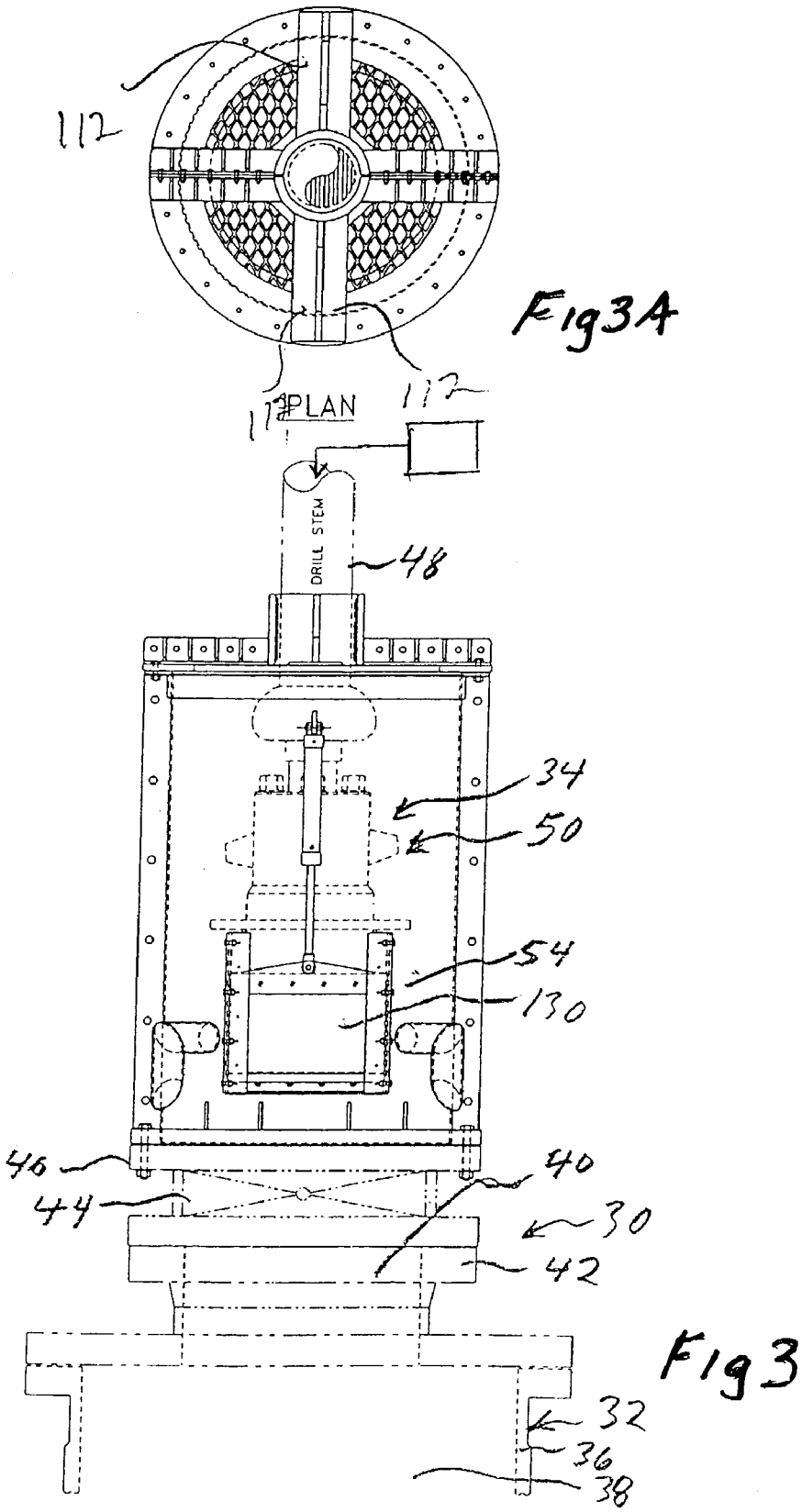
FIG. 3 is a front elevational view similar to FIG. 2.
FIG. 3*a* is a top plan view of the structure shown in FIG. 3.
Figure 8:
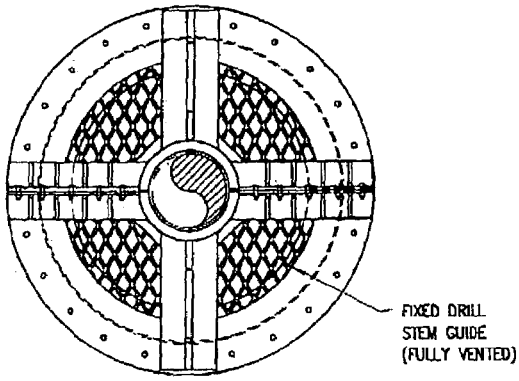
FIG. 8 is a drawing similar to FIG. 3, showing an alternative embodiment where the access door is hinge-mounted.
Figure 8:
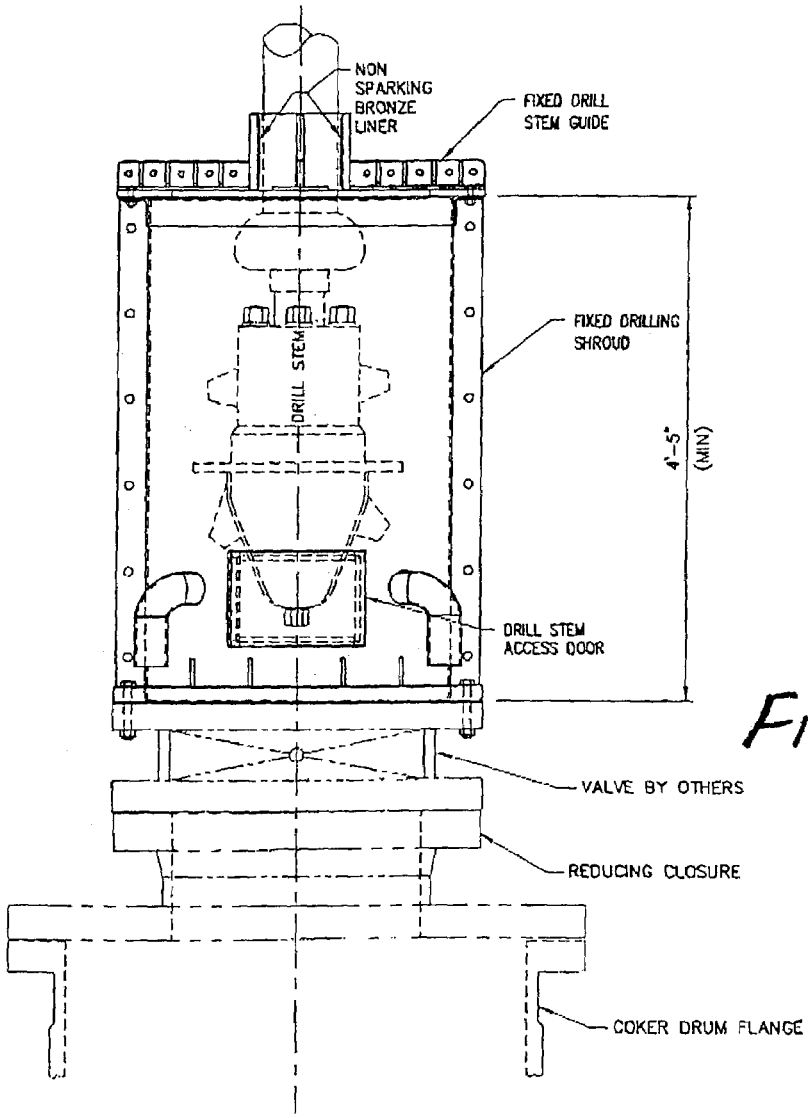

FIG. 8 is similar to FIG. 3, but shows a second embodiment of the present invention. Substantially, all of the components of FIG. 8 are, or may be, similar to or the same as in the first embodiment. There are some of the main components given a numerical designation with "a" suffix being added to differentiate these from the first embodiment. The main change made in this second embodiment, is that instead of having the door 130 slide-mounted for linear motion, the door 130*a* of this second embodiment is hinge-mounted along one side location at 168*a*. The door 130*a* can be manually moved from its closed position to its open position, and while in its closed position, it could be locked into that position. There are the coke drum 32*a*, the drill assembly 34*a* with a drill stem 48*a*, and the drill head 50*a*. Since these and other components are substantially the same as in the first embodiment, it is believed there is no need to add any further description or numerical designations for this second embodiment.

It is to be understood that the description in the present invention is to disclose what is the preferred embodiments, and this description is not intended to be limiting the claims to the particular subject matter disclosed herein. Rather, there could be a variety of substitutions of various components having a different design, configuration, and/or a particular manner of performing a function without departing from the basic teachings of the present invention. Thus, the particular shapes, modes of attachment, methods of control, and physical positioning could be modified without departing from the basic terms of the present invention.

We claim:

1. A safety system for use in a coking facility where there is a coke drum having an upper end opening defined by a surrounding opening structure of the coke drum, and a drill assembly comprising a drill stem, a drill head at a lower end portion of the drill stem, and a liquid discharge system to provide high pressure liquid for a liquid discharge section of the liquid discharge system at said drill head, said drill assembly being arranged to raise and lower said drill head between a lower operating location where the liquid discharge section is positioned to emit a liquid jet discharge in said coke drum for removal of coke material in the drum, and having an upper retracted position at a retracted location where said drill head is located above said drum, said system comprising:

a) an enclosing structure which is located above the upper end opening of the coke drum so as to enclose the retracted location in a manner that if the drill head is in the retracted location and emits a jet discharge therefrom, said enclosing structure causes the jet discharge to be redirected in the enclosing structure;

b) an access system which comprises an opening structure in said enclosing structure to provide access to said drill head in its retracted position, and a door which is movable between a closed position and an open position, with the door in its closed position blocking the jet discharge from passing out through the access opening, and with the door in its open position permitting access to the drill head inside said enclosing structure.

2. The system as recited in claim 1, wherein there is a guide section located relative to the enclosing structure so as to be above the drill head with the drill head in its retracted position, said guide section having a through opening to accommodate the drill stem and is arranged to center the drill stem so that the drill head properly travels into and from the drum.

3. The system as recited in claim 2, wherein said guide section further comprises a brass bushing which engages said drill stem to prevent unwanted sparking.

4. The system as recited in claim 2, wherein said guide section is arranged to limit upward travel of the drill head outside of a region within the enclosing structure.

5. The system as recited in claim 1, wherein there is a door interlock system which is responsive to the door being in its open or closed position, and also an operative connection to the liquid discharge system to be able to prevent flow of high pressure liquid from the liquid discharge section at the drill head in a manner that when the door is in the open position, jet liquid discharge from the discharge section at the drill head is prevented.

6. The system as recited in claim 5, wherein there is a door interlock control valve in the liquid discharge system, and said door interlock system operates to close said door interlock control valve when the door is in the open position.

7. The system as recited in claim 6, wherein there is a drill head position interlock system which is responsive to location of the drill head and has an operative connection to the liquid discharge section, said drill head position interlock system being arranged so that when the drill head is moved out of its operating position within the drum, the liquid discharge system is prevented from discharging liquid through the discharge section at the drill head.

8. The system as recited in claim 7, wherein the head position interlock system has a head position interlock control valve to prevent flow from the liquid discharge section as a jet discharge at the drill head, and the door interlock control valve and the drill head position interlock control valve are in series so that when either of the interlock systems is operative to close its control valve, flow of the jet discharge to the discharge section at the drill head is prevented.

9. The system as recited in claim 5, wherein there is a drill head position interlock system which is responsive to location of the drill head, and has an operative connection to the liquid discharge section, said drill head position interlock system being arranged so that when the drill head is moved out of its operating position within the drum, the liquid discharge section is prevented from discharging liquid through the discharge section at the drill head.

10. The system as recited in claim 1, wherein there is a venting system to cause cooling air to enter a region defined by the enclosing structure, and to flow through the region defined by the venting structure to have a cooling effect within the enclosing structure.

11. The system as recited in claim 10, wherein venting system comprises an inlet air section to enable air to enter into a lower portion of the region defined by the enclosing structure, and an air outlet section to enable flow in the region defined by the enclosing structure to flow outwardly from the enclosing structure.

12. The system as recited in claim 11, wherein said air outlet section comprises structure at an upper end location of said enclosing structure, and there is a venting structure at said upper end location.

13. The system as recited in claim 12, wherein there is a guide section located relative to the enclosing structure so as to be above the drill head with the drill head in its retracted position, said guide section having a through opening to accommodate the drill stem and to center the drill stem so that the drill head properly travels into and from the drum.

14. The system as recited in claim 1, wherein said door is hinge-mounted to the enclosing structure.

15. The system as recited in claim 1, wherein said door is slide-mounted to said enclosing structure.

16. A method for providing increased safety and reducing personnel exposure in a coking facility where there is a coke drum having an upper end opening defined by a surrounding opening structure of the coke drum, and a drill assembly comprising a drill stem, a drill head at a lower end portion of the drill stem, and a liquid discharge system to provide high pressure liquid for a liquid discharge section of the liquid discharge system at said drill head, said drill assembly being arranged to raise and lower said drill head between a lower operating location where the liquid discharge section is positioned to emit a liquid jet discharge in said coke drum for removal of coke material in the drum, and having an upper retracted position at a retracted location where said drill head is located above said drum, said method comprising:

a) positioning an enclosing structure above the upper end opening of the coke drum so as to enclose the retracted location in a manner that if the drill head is in the retracted location and emits a jet discharge therefrom, the enclosing structure functions to redirect the jet discharge;

b) providing access through said enclosing structure to said operating head in its retracted position by providing an access opening in the enclosing structure and also providing a door which is movable between a closed position and an open position, with the door in its closed position blocking the jet discharge from passing out through the access opening, and with the door in its open position permitting access to the drill head inside said enclosing structure.

17. The method as recited in claim 16, wherein said drill head is centered by positioning a guide section so that with the drill head in its retracted position, the guide section is above the drill head, and engaging the drill stem with the guide section to center the drill stem so that the drill head properly travels into and from the drum.

18. The method as recited in claim 16, comprising arranging a door interlock system to be responsive to the door being in its open or closed position, and operatively connected to the liquid discharge system, and operating said door interlock system to prevent flow of high pressure liquid from the liquid discharge section when the door is in the open position.

19. The method as recited in claim 18, comprising arranging a drill head position interlock system to be responsive to location of the drill head, and through an operative connection to the liquid discharge section so that when the drill head is moved out of its operating position within the drum, the liquid discharge section is prevented from discharging liquid through the discharge section at the drill head.

20. The method as recited in claim 1, further comprising directing cooling air into a region defined by the enclosing structure to flow through the region to have a cooling effect within the enclosing structure.

* * * * *